US007269382B2

(12) United States Patent
Hashimoto

(10) Patent No.: US 7,269,382 B2
(45) Date of Patent: Sep. 11, 2007

(54) DEVELOPING APPARATUS

(75) Inventor: Kazunori Hashimoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 10/923,817

(22) Filed: Aug. 24, 2004

(65) Prior Publication Data

US 2005/0047832 A1 Mar. 3, 2005

(30) Foreign Application Priority Data

Aug. 26, 2003 (JP) ..... 2003-301037

(51) Int. Cl.
*G03G 15/08* (2006.01)

(52) U.S. Cl. ..... 399/284; 399/285

(58) Field of Classification Search ..... 399/284, 399/285

See application file for complete search history.

(56) References Cited

U.S. PATENT DOCUMENTS 5,682,585 A * 10/1997 Yamaguchi et al. .... 399/284 X
6,064,837 A 5/2000 Hashimoto et al. ..... 399/50
6,278,849 B1 * 8/2001 Kawasaki ..... 399/284 X
6,393,238 B1 5/2002 Hashimoto et al. ..... 399/175
6,415,127 B1 7/2002 Yamamoto et al. ..... 399/284
6,591,072 B2 7/2003 Hashimoto et al. ..... 399/50
6,684,047 B2 * 1/2004 Kin et al. ..... 399/284
2003/0123907 A1 * 7/2003 Nonaka et al. ..... 399/257
2003/0128997 A1 * 7/2003 Sakaizawa et al. ..... 399/284 X

FOREIGN PATENT DOCUMENTS

JP 11249521 A * 9/1999
JP 2002-227695 8/2000

* cited by examiner

*Primary Examiner*—David M. Gray
*Assistant Examiner*—Erika J. Villaluna
(74) *Attorney, Agent, or Firm*—Fitzpatrick, Cella, Harper & Scinto

(57) ABSTRACT

A developing apparatus including a developer carrying member for carrying a developer for developing an electrostatic image, formed on an image bearing member, with the developer, a developer regulating member for regulating the developer carried on the developer carrying member, and an oscillating electric field forming device which forms an oscillating electric field between the developer carrying member and the developer regulating member, wherein a developer consuming operation is executed for consuming the developer from the developer carrying member to an image non-forming area of the image bearing member and a period of forming the oscillating electric field is provided in the operation.

12 Claims, 7 Drawing Sheets

DEVELOPING APPARATUS

BACKGROUND OF THE INVENTION

1. Field of the Invention

The present invention relates to a developing apparatus having a developer carrying member and a developer regulating member, and more particularly to a developing apparatus adapted for use in an image forming apparatus utilizing an electrophotographic process or an electrostatic recording process such as a copying apparatus, a printer, a facsimile apparatus, etc.

2. Description of the Related Art

In an image forming apparatus of electrophotographic process, a recorded image is formed by charging an image bearing member, then exposing it according to image information to form an electrostatic image, supplying the image bearing member with a developer according to such electrostatic image thereby forming a developer image, then transferring such a developer image by transfer means onto a recording material (transfer member) such as a recording sheet, an OHP sheet or a cloth, and fixing it by fixing means.

There is already known an image forming apparatus for example utilizing, as charging means, contact charging means which is maintained in contact with the image bearing member, and, as developing means, non-magnetic one-component contact developing means. FIG. 7 is a schematic cross-sectional view of principal portions of such conventional image forming apparatus 300.

The image forming apparatus 300 is provided with a drum-shaped electrophotographic photosensitive member (hereinafter called "photosensitive drum") 10 as an image bearing member. The surface of the photosensitive drum 10 is uniformly charged by applying a predetermined charging bias to a charging roller 11, serving as charging means which is in contact with and driven by the surface of the photosensitive drum 10. Then the surface of the photosensitive drum 10 is exposed, by an exposure apparatus 12, to a light L corresponding to an image information signal, thereby forming an electrostatic latent image.

The electrostatic latent image formed on the photosensitive drum 10 is supplied with a toner serving as developer, by a developing apparatus 13 serving as developing means and including, in a developing container 20, a developing roller 16 which is a roller-shaped developer carrying member, a developing blade 17 which is a blade-shaped regulating member, and a toner supply roller 18 which is a developer supplying member, whereby the latent image is rendered visible as a developer image (toner image).

Then, in a transfer portion N, a transfer bias is applied to a transfer roller 26 constituting transfer means, whereby the toner image formed on the photosensitive drum 10 is transferred onto a recording material P, supplied from a recording material supply portion 40 equipped with a recording material cassette 41, a recording material supply roller 42 serving as conveying means etc., thereby forming an unfixed image. Then the recording material P is conveyed to a fixing apparatus 30 in which the unfixed image is fixed to the recording material P, and is thereafter discharged to a sheet discharge tray 35 whereupon the image formation is terminated.

Transfer residual toner, which has not been transferred but remains on the photosensitive drum 10, is recovered by a cleaning blade 14 constituting cleaning means into a waste toner container 15. Thus the photosensitive drum 10 is cleaned and is used for image formation repeatedly.

On the other hand, particularly in a conventional contact developing method (in which a developing roller is in contact with an image bearing member at the image development), because of a high developing selectivity, toner of higher developing property on the developing roller 16 is preferentially used for the development in the developing step, so that toner of inferior developing property remains in the developing container 20. When a remaining amount of the toner is reduced, the toner in the developing container 20 shows an increase in the proportion of the toner of inferior developing property and causes deterioration of the toner itself, thereby resulting in an increased fogging in a latter part of a printing durability test, a decrease in the transfer efficiency in an image of a halftone pattern, or in a so-called white-spots-image caused by defective transfer in many small areas on an image.

Therefore, as described in Japanese Patent Application Laid-open No. 2000-227695, in an image forming apparatus having rotary development means, the toner of inferior developing property is forcedly consumed for example by providing forced consumption means which causes a forced consumption of a toner layer sticking to the external periphery of the developing roller 16 in a final stage of an operation for optimizing the developing conditions, or by forming a solid image of a high coverage rate (image of maximum density) by executing a charging of the photosensitive drum 10, an exposure thereof and a development and recovering the toner into the waste toner container 15 without being transferred to the recording material P, at every predetermined number of prints.

However, even with such forced toner consumption by the solid image printing at every predetermined number of prints, the toner of inferior developing property may still not be transferred onto the photosensitive drum 10 but remain on the developing roller 10 in the developing step, so that the toner of inferior developing property cannot be sufficiently transferred to the photosensitive drum 10 thereby resulting in an increase of fogging in a latter part of the service life of the developing apparatus or a white-spots-image in a halftone patterned image.

Furthermore, in a latter part of the service life of the developing apparatus, there are sometimes observed a black-lined image caused by a fusion-bonding of deteriorated toner on the developing blade 17, an increase of fogging caused by a fusion-bonding of toner on the developing roller 16, and a white-spots-image in a halftone patterned image.

SUMMARY OF THE INVENTION

An object of the present invention is to provide a developing apparatus capable of forcedly consuming a developer of an inferior developing property.

Another object of the present invention is to provide a developing apparatus capable of reducing a development failure which is generated when a developer of an inferior developing property is present in a high proportion in the developing apparatus.

Still another object of the present invention is to provide a developing apparatus capable of reducing a black-lined image which is generated by fusion-bonding of a developer on a developer regulating member.

Still another object of the present invention is to provide a developing apparatus capable of constantly providing a satisfactory image regardless of a process of use.

Still another object of the present invention is to provide a developing apparatus capable of reducing an increase of fogging, a white-spots-image in a halftone patterned image or a black-lined image in a latter part of the service life of the developing apparatus.

Still other objects of the present invention, and features thereof, will become fully apparent from the following detailed description, which is to be taken in conjunction with the accompanying drawings.

DETAILED DESCRIPTION OF THE PREFERRED EMBODIMENTS

In the following, a developing apparatus of the present invention will be explained in detail with reference to the accompanying drawings.

EXAMPLE 1

Figure 1:
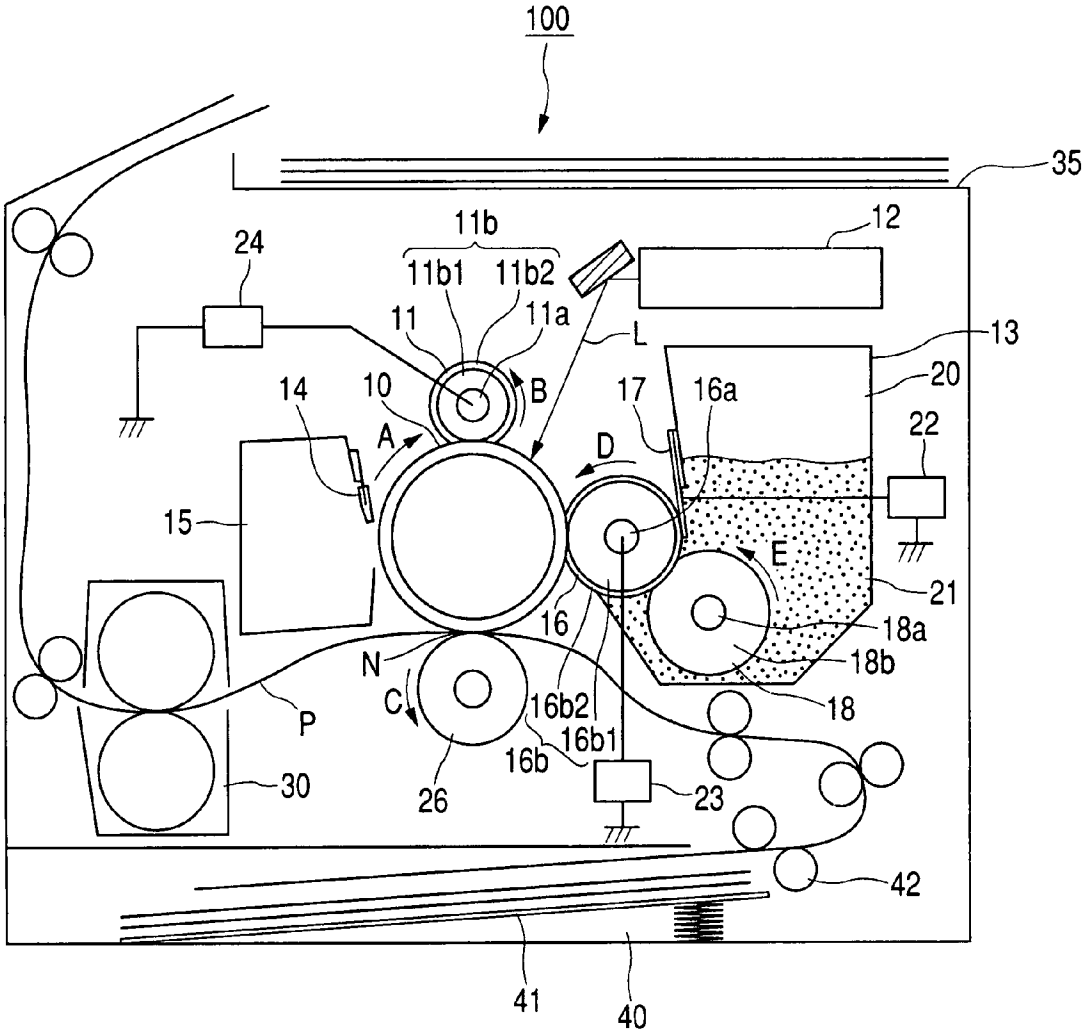
FIG. 1 is a schematic cross-sectional view of an image forming apparatus embodying the present invention.
Figure 7:
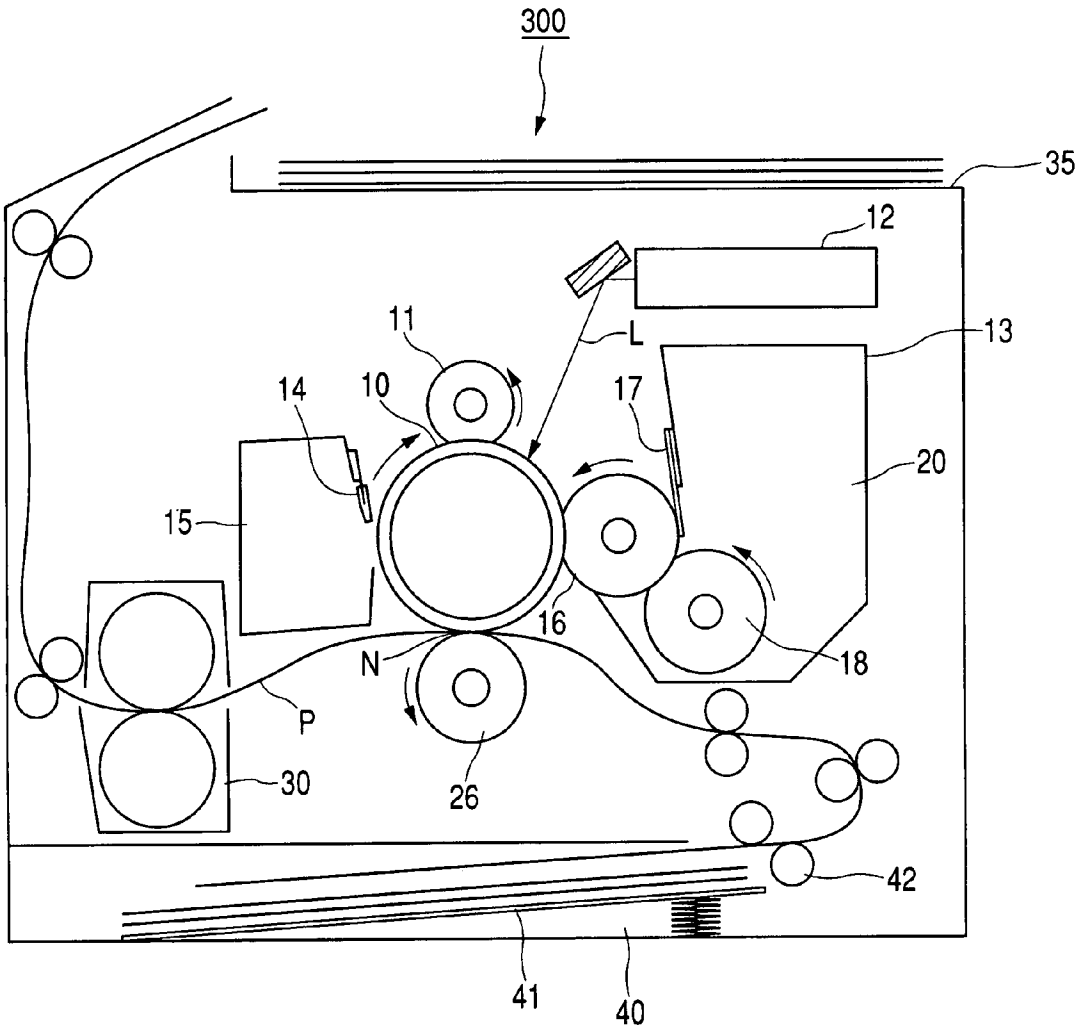
FIG. 7 is a cross-sectional view showing an example of a conventional image forming apparatus.

FIG. 1 is a schematic cross-sectional view of an example of an image forming apparatus of the present invention. An image forming apparatus 100 of the present example is capable of forming an image on a recording material such as a recording paper, an OHP sheet, a cloth, etc. by an electrophotographic process, according to an image information signal from an external host equipment such as a personal computer, connected communicably with a main body of the apparatus. Components equivalent in function or configuration to those in a conventional image forming apparatus shown in FIG. 7 are represented by same numbers.

The image forming apparatus 100 of the present example is provided with a drum-shaped electrophotographic photosensitive member (photosensitive drum) 10, serving as an image bearing member. In the present example, the photosensitive drum 10 is formed by coating an external periphery of an aluminum cylinder of a diameter of 30 mm with an organic photoconductor (OPC). However such configuration is not restrictive, and a-Si (amorphous silicon), CdS, Se etc. may be coated instead of an organic photoconductor.

The photosensitive drum 10, rotated by drive means (not shown) in a direction indicated by the arrow A at a process speed of 100 mm/sec, is uniformly charged by a charging roller 11, serving as charging means which is maintained in contact with the photosensitive drum 10 and is driven thereby in a direction indicated by the arrow B.

The charging roller 11 has a diameter of 12 mm and is of a multi-layered structure having, around a cylindrical metal core 11*a* of stainless steel, an elastic layer 11*b* constituted of a base layer 11*b*1 of urethane rubber and a surface layer 11*b*2 of a fluorinated resin. The metal core 11*a* may also be formed by another metal such as aluminum or an aluminum alloy. Also the base layer 11*b*1 of the elastic layer 11*b* may be formed by a rubber material such as NBR, EPDM or silicone rubber. The surface layer 11*b*2 of the elastic layer 11*b* may also be formed by either urethane or nylon.

The charging roller 11 is connected to a charging bias source apparatus 24 serving as voltage application means for the charging member, and is given a DC charging bias of −950 V. In this manner, a dark potential of −450 V is realized on the surface of the photosensitive drum 10. The present example employs a DC charging bias, but there may also be employed a charging bias in which an AC component is superposed with a DC component.

Then, on the surface of the photosensitive drum 10, an electrostatic latent image is formed by an exposure apparatus 12 constituting exposure means. In the present example, the exposure apparatus 12 is constituted of a laser scanner, in which a semiconductor laser (not shown) emits a laser beam L in response to an image signal coffesponding to an input signal, and such a laser beam L is reflected by a polygon mirror (not shown) rotated at a high speed, then transmitted by an image lens group (not shown) and irradiates the photensitive drum 10. The irradiation of the laser beam forms a light potential of -120V on the photosensitive drum 10.

Such electrostatic latent image is rendered visible as a developer image (toner image) by a developing apparatus 13 constituting developing means.

In the following, there will be given an explanation on the developing apparatus 13. The present example employs a non-magnetic one-component contact developing method. The developing apparatus 13 is provided with a toner container 20 constituting a developing container. The toner container 20 contains, as developer, a non-magnetic one-component developer (hereinafter called "toner") of a negative charge polarity (same as the polarity of the charging bias) for reversal development. The toner container 20 initially contains 150 g of the toner.

The developing apparatus 13 is also provided with a toner supplying roller 18 rotating in a direction indicated by the arrow E as developer supply means. The toner supplying roller 18 is constituted of a sponge roller of a diameter of 18 mm, having an elastic layer 18*b* of foamed urethane around a metal cylinder 18*a* of aluminum, an aluminum alloy, stainless steel etc.

The developing apparatus 13 is further provided with a developing roller 16 serving as a developer carrying member for carrying the toner to a portion (developing area) opposed to the photosensitive drum 10. The toner is supplied onto the developing roller 16 by the contact of the toner supply roller 18 and the developing roller 16 and by a toner deposition from the toner supply roller 18 to the developing roller 16. The toner supply roller rotates in a direction opposite to the rotating direction of the developing roller at a contact portion therewith, thereby also exerting an effect of peeling the toner off the developing roller.

The developing roller 16 is rotated in a direction indicated by the arow D shown in the drawing, by a developing roller rotating apparatus (not shown). The developing roller 16 has a diameter of 18 mm and is of a multi-layered structure having, around a stainless steel cylinder 16*a*, an elastic layer 16*b* constituted of a base layer 16*b*1 of urethane rubber and a surface layer 16*b*2 of urethane rubber mixed with carbon. However such configuration is not restrictive, and it is also possible to constitute the metal core 16*a* with a metal cylinder such as of aluminum, an aluminum alloy or stainless steel, the base layer **16*b*1 of the elastic layer 16*b* with a rubber material such as NBR, EPDM, silicone rubber or urethane rubber, and the surface layer 16*b*2** with either urethane or nylon.

The developing roller 16 is given a DC developing bias voltage of −300 V by a developing bias source apparatus 23 serving as voltage application means for the developer carrying member. Thus, when the developing roller 16 contacts the photosensitive drum 10, the toner is transferred from the developing roller 16 onto the photosensitive drum 10 according to the electrostatic latent image formed thereon, thereby forming a toner image. The developing bias can also be a bias voltage formed by superposing an AC component with a DC component. The present example employs a reversal developing method in which the toner transfers from the developing roller to a light area (exposed area) of the photosensitive drum.

Furthermore, the developing apparatus 13 is provided with a developing blade 17 as a developer regulating member for regulating a toner amount to be carried on the developing roller 16. The toner on the developing roller 16 is regulated to an optimum layer thickness and is triboelectrically charged in a negative polarity by the developing blade 17.

The developing blade 17 of the present example is constituted of a phosphor bronze plate of a straight shape, having a spring elasticity and coated with nylon on a contact surface with the developing roller 16. However, such a configuration is not restrictive, and it is also possible to dispense with the coating material on the contact face with the developing roller 16 or to employ a metal plate such as a stainless steel plate instead of the phosphor bronze plate. Furthermore, the plate constituting the developing blade 17 may have an L-shaped front end, and a rubber material or the like may be adhered to or coated, instead of nylon, on the metal plate at the contact surface between the developing blade 17 and the developing roller 16.

The developing blade 17 is given, by a developing blade bias source apparatus 22 constituting voltage application means for the regulating member, a DC blade bias voltage of −300 V, which is the same as the developing bias applied to the developing roller 16. Thus, during the developing operation, a potential difference is 0 V between the developing roller 16 and the developing blade 17.

In synchronization with the toner image formation on the photosensitive drum 10, a recording material P is supplied to the transfer portion N, from a recording material supply portion 40 which is provided with a recording material cassette 41, a recording material supply roller 42 as conveying means etc. In the transfer portion N, opposed to the photosensitive drum 10, there is provided a transfer roller 25 constituting transfer means and rotated in a direction indicated by the arrow C in the drawing. The transfer roller 26 is given a predetermined transfer bias (positive polarity) by a transfer bias source apparatus (not shown) constituting voltage application means for the transfer member, whereby the toner image is transferred from the photosensitive drum 10 to the recording material P, thereby forming an unfixed image thereon. The recording material P is thereafter conveyed to a fixing apparatus 30 in which the unfixed image is fixed to the recording material P. Thereafter the recording material P bearing the fixed image is conveyed to a sheet discharge tray 35, whereupon the image formation is terminated.

Transfer residual toner, which has not been transferred but remains on the photosensitive drum 10, is recovered by a cleaning blade 14 constituting cleaning means into a waste toner container 15. Thus the photosensitive drum 10 is cleaned and is used for image formation repeatedly.

In the following, there will be explained forced toner consumption means in the present example.

The image forming apparatus 100 of the present example executes, at a predetermined timing in an image non-forming period, a forced toner consumption mode in which the toner deposited on the external periphery of the developing roller 16 is forcedly consumed onto the photosensitive drum 10. The "image non-forming period" means a period other than an "image forming period" for forming an image to be outputted by transfer to the recording material. Thus the toner consumption mode consumes the toner of the developing roller 16 onto an image non-forming area of the photosensitive drum 10. An image non-forming area means an area other than the area to be used for image formation in response to an external image information signal.

Figure 2:
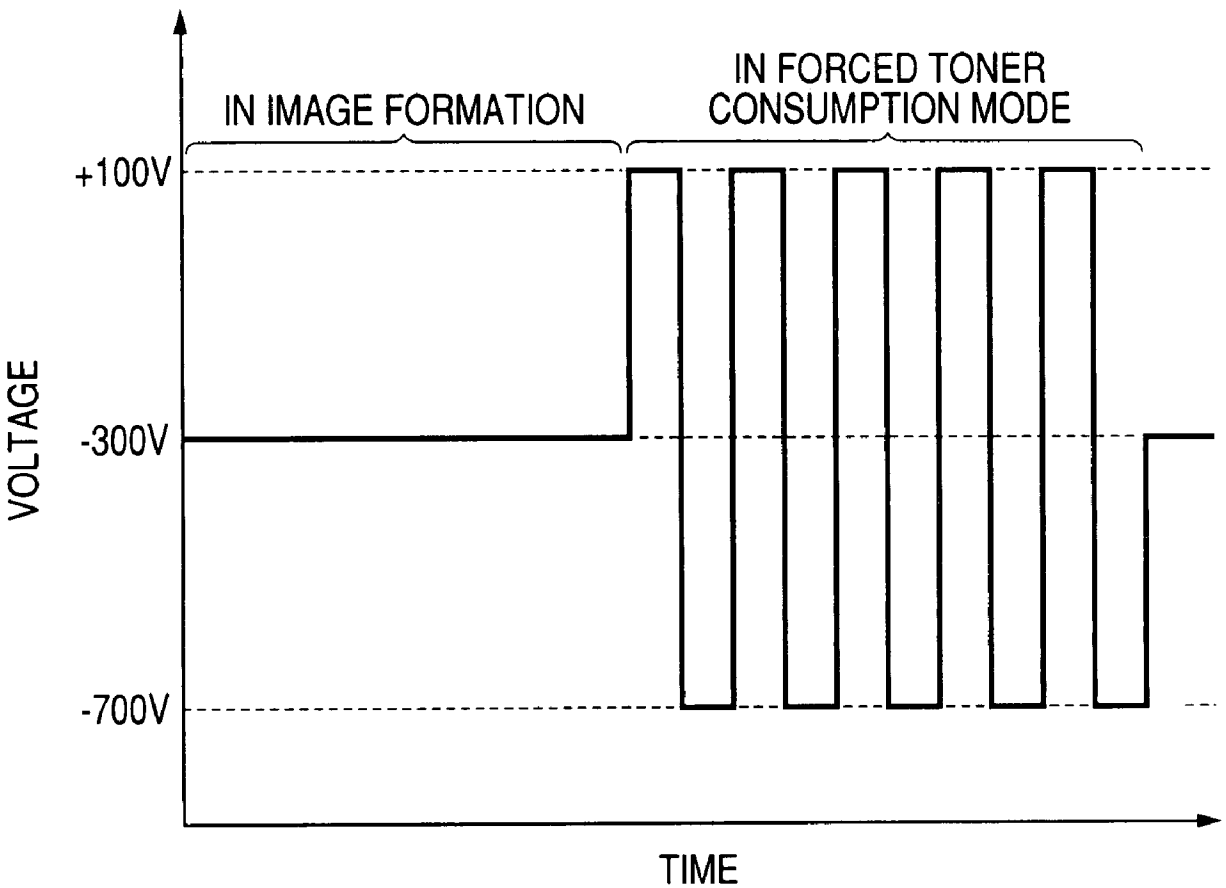
FIG. 2 is a chart showing a blade bias output voltage in an ordinary image formation and a forced toner consumption mode in the present invention.

FIG. 2 shows a developing blade bias voltage applied to the developing blade. During the forced toner consumption mode, the blade bias applied to the developing blade 17 by the developing blade bias source apparatus 22 is not a DC voltage (−300 V) applied during the ordinary image formation (developing operation) but a square waveform oscillating voltage as shown in FIG. 2. Referring to FIG. 2, the oscillating voltage is formed by superposing a DC voltage of −300 V and an AC voltage of 800 Vpp. During the forced toner consumption mode, the developing roller 16 is given a DC voltage of −300 V as in the developing operation. Therefore, during the forced toner consumption mode, an oscillating electric field is formed between the developing blade and the developing roller, by the developing blade bias source apparatus 22 which serves as oscillating electric field forming means. In this manner, during the toner consumption mode, there is provided a period in which an oscillating electric field is formed between the developing blade and the developing roller.

The application of an oscillating voltage to the developing blade 17 changes the coated state of the toner on the developing roller 16, and provides a charge also to the toner of the inferior developing property, thereby stimulating the consumption thereof onto the photosensitive drum 10. Therefore the toner of the inferior developing property is less accumulated in the toner container 20, and it is rendered possible to suppress an increase of fogging and a white-spots-image in a halftone patterned image in a latter part of the printing durability test.

Also an alternating electric field formed between the developing roller 16 and the developing blade 17 generates a potential difference therebetween, thereby peeling off toner or external additives of the toner sticking to the developing roller 16 and the developing blade 17. Thus, the forced toner consumption mode, suitably executed, periodically removes the deposits sticking to the developing roller 16 and the developing blade 17 thereby avoiding fusion-bonding of the toner. It is thus possible to suppress formation of a black-lined image and an increase in the fogging.

In the following, operations of the forced toner consumption mode will be explained in more detail.

In the present example, as a predetermined timing of the image non-forming state, the forced toner consumption mode is executed at every 100 image formations. In the forced toner consumption mode, the charging bias source apparatus 24 applies a charging bias of −950 V to the charging roller 11, thereby charging the photosensitive drum 10. Then the exposure apparatus 12 exposes the photosensitive drum 10 by a length of 100 mm in the rotating direction thereof, thereby forming a latent solid image of a potential of −120 V. Such a solid image is formed because it securely reduces the potential of the latent image in comparison with a line image, thereby facilitating the consumption even of the toner of the inferior developing property onto the photosensitive drum. Also such a solid image can avoid a drawback that the toner tends to remain on the developing roller by a round-about development by the toner on the developing roller as in the case of a line image.

Figure 3:
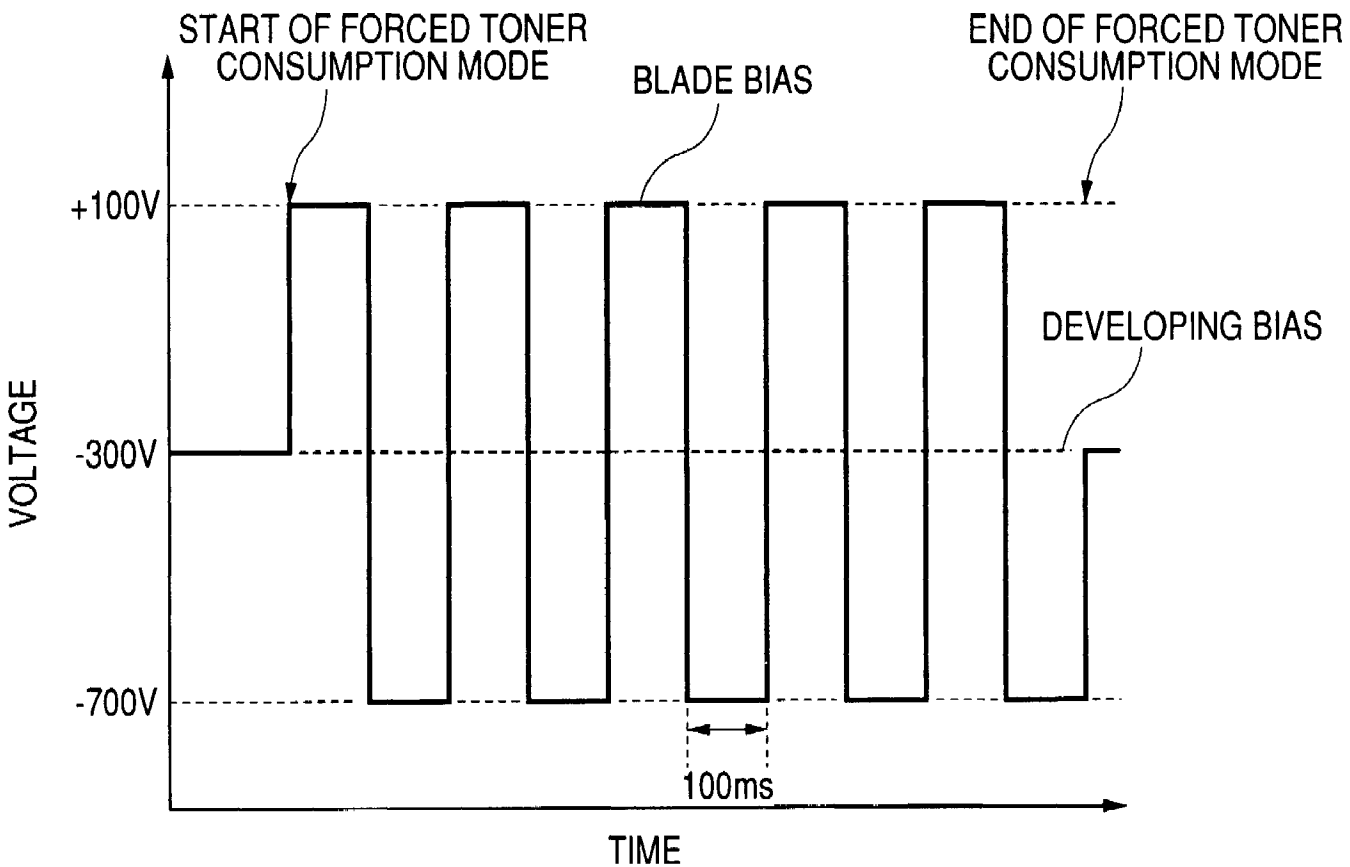
FIG. 3 is a chart showing output voltages of a blade bias and a developing bias in an ordinary forced toner consumption mode of the present invention.

On the other hand, as shown in FIG. 3, the developing roller 16 is given a developing bias of −300 V by the developing bias source apparatus 23, while the developing blade 17 is given, by the developing blade bias source apparatus, a square waveform AC voltage which is changed from −700 V to +100 V at every 100 ms.

The developing roller 16 is rotated in this state to execute a developing step on a length of 100 mm. Stated differently, the oscillating voltage is in advance applied to the developing blade 17 in the developer regulating position thereof, corresponding to the area where the toner is consumed from the developing roller 16 to the photosensitive drum 10 by the forced toner consumption mode.

While the toner of 100 mm in length, consumed from the developing roller 16 to the photosensitive drum 10, passes through the transfer position, the transfer roller 26 is separated from the photosensitive drum 10 by transfer roller separating means (not shown). Therefore the toner, transferred from the developing roller 16 to the photosensitive drum 10, reaches the cleaning blade 14 without touching the transfer roller, and is then carried to the waste toner container 15.

After the forced toner consumption mode is executed in this manner, a next image formation is executed.

According to the investigation of the present inventors, in order to consume the toner of the inferior developing property and to eliminate the deposits sticking to the developing roller 16 and the developing blade 17, a higher effect can be exhibited by employing a blade bias, supplied to the developing blade 17, preferably having a value of −500 V or lower in the negative side and −100 V or higher in the positive side, and more preferably having a value of −700 V or lower in the negative side and +100 V of higher in the positive side. Stated differently, on the basis of the developing bias voltage, there is preferably employed an AC voltage of 200 V or larger in absolute value, more preferably 400 V larger. The present example employs a blade bias, supplied to the developing blade 17, formed by a square waveform AC voltage changing at every 100 ms namely with a frequency of 5 Hz, but a frequency equal to or higher than 100 Hz in fact reduces the deposit eliminating effect, because such frequency increases a number of alternations per unit time but the toner starting fusion becomes unable to follow such alternations and therefore becomes less strippable.

In the present example, a square waveform AC voltage is employed as the blade bias applied to the developing blade 17. Such an AC voltage can also be a triangular waveform AC voltage or a sinusoidal waveform AC voltage, but a square waveform AC voltage having a steep voltage change has the highest effect for eliminating the deposits.

[Image Evaluation]

Then the effect of the forced toner consumption operation was evaluated. A print test for 5,000 prints was executed with an image of a coverage rate of 5%. In addition to the case of executing the forced toner consumption mode of the aforementioned example 1, a similar test was conducted also on a case without the forced toner consumption mode (Comparative Example 1) and a case the AC blade bias is not applied in the forced toner consumption mode (Comparative Example 2).

Figure 4:
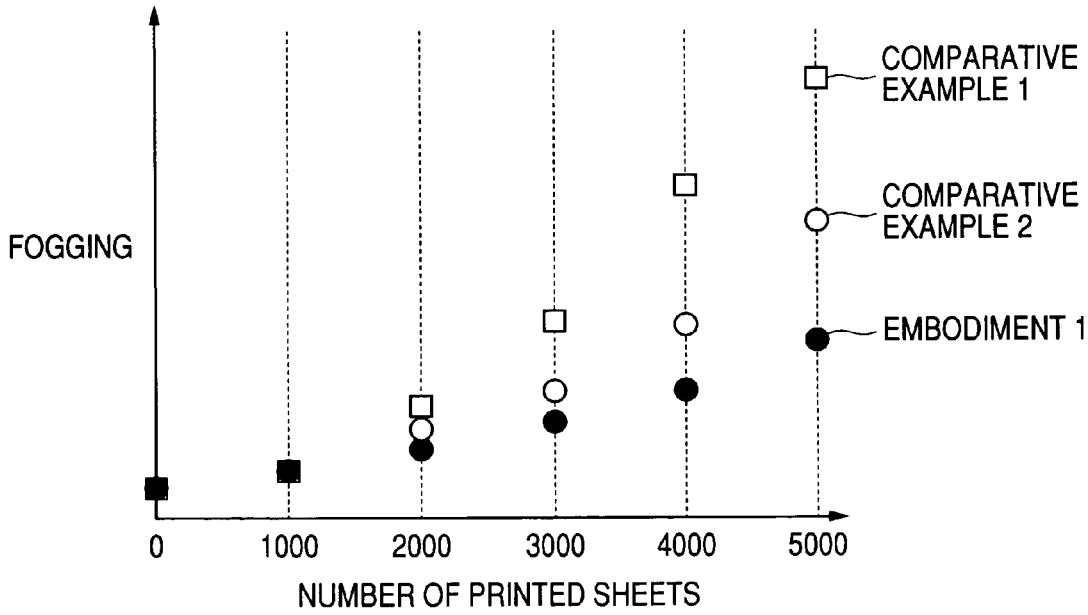
FIG. 4 is a chart showing results of a relationship between a number of prints and a fog level in a print durability test

Obtained results are shown in FIG. 4, Tables 1 and 2. FIG. 4 shows a change in the fog as a function of print number in the print durability test, wherein the abscissa indicates a number of prints while the ordinate indicates an amount of fog evaluated by the amount of toner deposited in a white background (non-printed area) on the photosensitive drum. Also Table 1 indicates a rank of the white-spots-image in a halftone image, as a function of a number of prints in the print durability test. The image was ranked as satisfactory (o) in case the image did not show white spots, medium (A) in case the image showed white spots in a part, and poor (x) in case the image showed white spots in the entire image area.

TABLE 1

| | Print number | | | | | |
|---|---|---|---|---|---|---|
| | 0 | 1000 | 2000 | 3000 | 4000 | 5000 |
| Example 1 | ○ | ○ | ○ | ○ | ○ | Δ |
| Comp. Ex. 1 | ○ | ○ | Δ | Δ | x | x |
| Comp. Ex. 2 | ○ | ○ | ○ | ○ | Δ | x |

Also Table 2 indicates a rank of the black-lined image as a function of a number of prints in the print durability test. The image was ranked as satisfactory (○) in case the image did not show black lines, medium (Δ) in case the image showed black lines in a part, and poor (x) in case the image showed black lines in the entire image area.

TABLE 2

| | Print number | | | | | |
|---|---|---|---|---|---|---|
| | 0 | 1000 | 2000 | 3000 | 4000 | 5000 |
| Example 1 | ○ | ○ | ○ | ○ | ○ | Δ |
| Comp. Ex. 1 | ○ | ○ | Δ | x | x | x |
| Comp. Ex. 2 | ○ | ○ | ○ | Δ | Δ | x |

As will be apparent from the results shown in FIG. 4, Tables 1 and 2, Example was superior to Comparative Examples 1 and 2 in the fogging, the white-spots image in the halftone pattern and the black-lined image in the latter part of the print durability test.

As explained in the foregoing, it is possible to achieve improvements on the fogging, the white-spots image in the halftone pattern and the black-lined image in the latter part of the print durability test, by the forced toner consumption mode in which the toner is consumed by executing development in a state of applying a square-wave AC voltage to the developing blade 17 by the developing blade bias source apparatus 22.

EXAMPLE 2

In the following there will be explained another example of the developing apparatus of the present invention. An image forming apparatus of this example is a color image forming apparatus, capable of forming a full-color image by an electrophotographic process, according to an image information signal from an external host equipment such as a personal computer, connected communicably with a main body of the apparatus.

Figure 5:
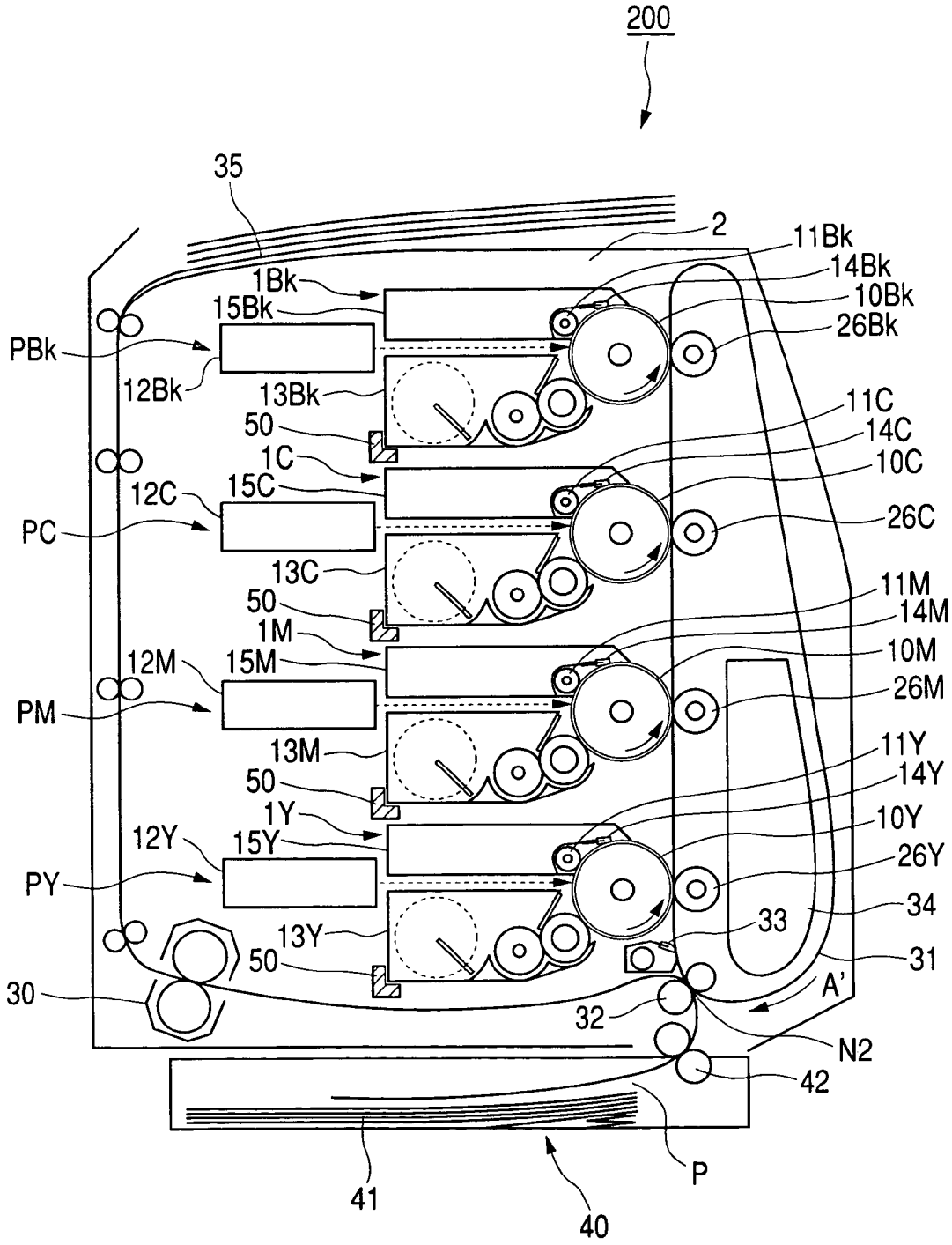
FIG. 5 is a schematic cross-sectional view showing another embodiment of the image forming apparatus of the present invention.

FIG. 5 is a schematic cross-sectional view of the color image forming apparatus 200 of the present example. The image forming apparatus 200 is provided, as image forming means, with first to fourth image forming portions (image forming units) PY, PM, PC, PBk for respectively forming images of yellow (Y), magenta (M), cyan (C) and black (Bk). The image forming apparatus 200 of the present example is a full-color printer of a so-called tandem type, in which the four image forming portions PY, PM, PC and PBk are arranged in parallel, along an intermediate transfer belt 31 rotating in a direction indicated by the arrow A' in the drawings, as an intermediate transfer member.

Figure 6:
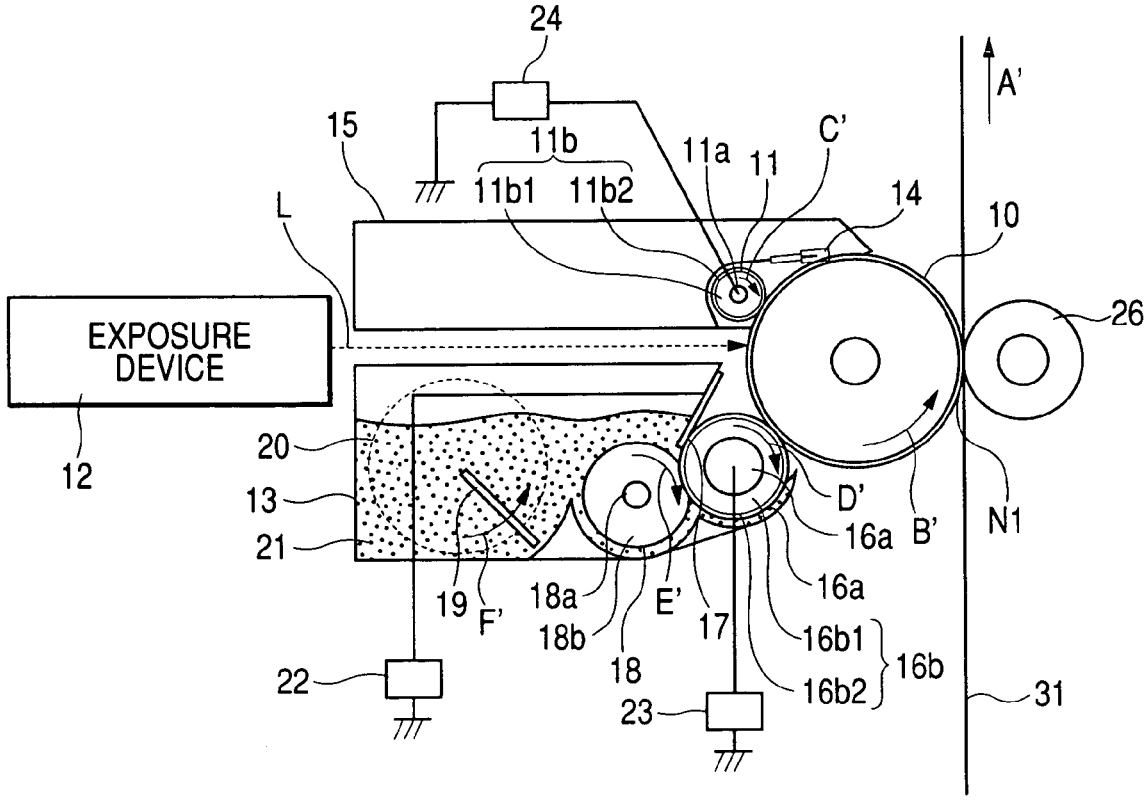
FIG. 6 is a schematic cross-sectional view showing details of an image forming portion of the image forming apparatus shown in FIG. 5.

FIG. 6 shows details of the image forming portion. The image forming portions of the respective colors have a same configuration except for a difference in the color of the formed image, and will therefore be explained collectively, omitting suffixes Y, M, C and Bk indicating the respective colors belonging to the image forming portions as long as such a distinction is unnecessary. Also an image forming process in each image forming portion is basically the same as that of the image forming apparatus 100 explained in Example 1.

Each image forming portion is provided with a photosensitive drum 10 as an image bearing member. A surface of the photosensitive drum 10 is uniformly charged by a charging roller 11, which is rotated by the photosensitive drum 10. Then the surface of the photosensitive drum 10 is exposed with a light L corresponding to image information signal from an exposure apparatus 12, whereby an electrostatic latent image is formed. The electrostatic latent image formed on the photosensitive drum 10 is developed in a developing apparatus 13 to form a visible toner image.

In forming a full-color image, toner images of respective colors, formed on the photosensitive drums 10 in the respective image forming portions, are transferred in primary transfer portions N1 where photosensitive drum 10 and a primary transfer roller 26 are opposed in each image forming portion, by an application of a predetermined primary transfer bias to the primary transfer roller 26 constituting primary transfer means from a primary transfer bias source apparatus (not shown), in succession and in superposition onto the intermediate transfer belt 31, thereby forming a full-color image thereon.

Then, by an application of a predetermined secondary transfer bias to a secondary transfer roller 32 constituting secondary transfer means from a secondary transfer bias source apparatus (not shown), the toner image on the intermediate transfer belt is secondary transferred onto a recording material P. The recording material P is supplied, in synchronization with the image formation on the intermediate transfer belt 31, from a recording material supply portion 40 including a recording material cassette 41, a recording material supply roller 42 as conveying means, etc., to a secondary transfer portion N2 where the intermediate transfer belt 31 and the secondary transfer roller 32 are opposed.

Thereafter the recording material P is conveyed to a fixing apparatus 30 in which the unfixed image is fixed to the recording material P, and is then discharged to a sheet discharge tray 35 whereupon the image formation is terminated.

Transfer residual toner, which has not been transferred but remains on the photosensitive drum 10 in a primary transfer, is recovered by a cleaning blade 14 constituting image bearing member cleaning means into a waste toner container 15, whereby the photosensitive drum 10 is cleaned. On the other hand, secondary transfer residual toner, which has not been transferred but remains on the intermediate transfer belt 31 in a secondary transfer, is scraped off by an intermediate transfer belt cleaning blade 33 constituting intermediate transfer member cleaning means, carried by toner carrying means (not shown) and is recovered into an intermediate transfer belt waste toner container 34, whereby the intermediate transfer belt 31 is cleaned.

More specifically, the photosensitive drum 10 in the present example is formed by coating an external periphery of an aluminum cylinder of a diameter of 35 mm with an organic photoconductor (OPC). However such configuration is not restrictive, and a-Si (amorphous silicon), CdS, Se, etc. may be coated instead of an organic photoconductor. The photosensitive drum 10, rotated by drive means (not shown) in a direction indicated by the arow B' at a process speed of 100 mm/sec, is uniformly charged by a charging roller 11, driven in a direction indicated by the arrow C' by the photosensitive drum 10.

The charging roller 11 has a diameter of 10 mm and is of a multi-layered structure having, around a cylindrical metal core 11*a* of stainless steel, an elastic layer 11*b* constituted of a base layer 11*b*1 of urethane rubber and a surface layer 11*b*2 of a fluorinated resin. The metal core 11*a* may also be formed by another metal such as aluminum or an aluminum alloy. Also the base layer 11*b*1 of the elastic layer 11*b* may be formed by a rubber material such as NBR, EPDM or silicone rubber. The surface layer 11*b*2 of the elastic layer 11*b* may also be formed by either urethane or nylon.

The charging rollers 11 of the image forming portions PY, PM, PC, PBk for yellow, magenta, cyan and black colors are connected to a common charging bias source 24 serving as voltage application means for the charging member, and are given a DC charging bias of −950 V. In this manner, a dark potential of −450 V is realized on the surface of the photosensitive drum 10. The present example employs a DC charging bias, but there may also be employed a charging bias in which an AC component is superposed with a DC component.

In the exposure apparatus 12, a semiconductor laser (not shown) emits a laser beam L in response to a color-separated image signal corresponding to an input signal, and such laser beam L is reflected by a polygon mirror (not shown) rotated at a high speed, then transmitted by an image lens group (not shown) and irradiates the photosensitive drum 10. The irradiation of the laser beam forms a light potential of −120 V on the photosensitive drum 10.

Such an electrostatic latent image is rendered visible as a developer image (toner image) by a developing apparatus 13.

The present example employs a non-magnetic one-component contact developing method. The developing apparatus 13 has a configuration similar to that of the image forming apparatus 1 in Example 1, and is provided with a toner container 20 containing a toner 21 which is a non-magnetic one-component developer. The toner container 20 initially contains 150 g of the toner. The toner 21 is carried to a toner supplying roller 18 by a rotation in a direction indicated by the arrow F' of a toner carrying sheet 19 constituting developer agitating/carrying means.

The toner supplying roller 18 is rotated in a direction indicated by the arrow E' in the drawing. The toner supplying roller 18 is constituted of a sponge roller of a diameter of 16 mm, having an elastic layer 18*b* of foamed urethane around a metal cylinder 18*a* of aluminum, an aluminum alloy, stainless steel, etc. The toner is supplied onto the developing roller 16 by the contact of the toner supply roller 18 and the developing roller 16 and by a toner deposition from the toner supply roller 18 to the developing roller 16. The toner supply roller also exerts an effect of peeling off the toner remaining on the developing roller.

The developing roller 16 is rotated in a direction indicated by the arrow D' shown in the drawing, by an drive means (not shown). The developing roller 16 has a diameter of 16 mm and is of a multi-layered structure having, around a stainless steel cylinder 16*a*, an elastic layer 16*b* constituted of a base layer 16*b*1 of urethane rubber and a surface layer 16*b*2 of urethane rubber mixed with carbon. However such configuration is not restrictive, and it is also possible to constitute the metal core 16*a* with a metal cylinder such as of aluminum, an aluminum alloy or stainless steel, the base layer 16*b*1 of the elastic layer 16*b* with a rubber material such as NBR, EPDM, silicone rubber or urethane rubber, and the surface layer 16*b*2 with ether urethane or nylon. The developing roller 16 is given a DC developing bias voltage of −300 V by a developing bias source apparatus 23. Thus, when the developing roller 16 contacts the photosensitive drum 10, the toner is transferred from the developing roller 16 onto the photosensitive drum 10 according to the electrostatic latent image formed thereon, thereby forming a toner image. The developing bias can also be a bias voltage formed by superposing an AC component with a DC component.

The toner on the developing roller 16 is regulated to be an optimum layer thickness and is charged in a negative polarity by the developing blade 17. The developing blade 17 of the present example is constituted of a phosphor bronze plate of a straight shape, having a spring elasticity and coated with nylon on a contact surface with the developing roller 16. However, such a configuration is not restrictive, and it is also possible to dispense with the coating material on the contact face of the developing roller 16 or to employ a stainless steel plate instead of the phosphor bronze plate. Furthermore, the plate constituting the developing blade 17 may have an L-shaped front end, and a rubber material or the like may be adhered to or coated, instead of nylon, on the metal plate at the contact surface between the developing blade 17 and the developing roller 16.

During the developing operation, the developing blade 17 is given, by a developing blade bias source apparatus 22 constituting voltage application means for the regulating member, a DC blade bias voltage of −300 V, which is same as the developing bias applied to the developing roller 16.

In the present example, the rotated photosensitive drum 10, the charging roller 11 for uniformly charging the surface of the photosensitive drum 10, and the cleaning means 11 are integrally supported, together with the developing apparatus 13, to constitute a process cartridge 1 which is detachably mountable on a main body 2 of the image forming apparatus. Process cartridges 1Y, 1M, 1C, 1Bk for the respective colors are detachably mounted, by mounting means 50 provided in the main body 2 of the image forming apparatus, in the main body 2 of the image forming apparatus. However, the process cartridge is not limited to such configuration, and it is possible, for example, to provide the developing apparatus 13 only fixed in the main body 2 of the image forming apparatus. Stated differently, the process cartridge may contain at least one of a photosensitive member serving as an image bearing member, charging means for charging the photosensitive member, developing means which supplies the photosensitive member with a developer and developing means which supplied the photosensitive member with the developer, as an integral cartridge which is detachably mountable in the main body of the image forming apparatus. On the other hand, it is also possible to construct the developing apparatus 13 only as a cartridge (developing cartridge) detachably mounted in the main body 2 of the image forming apparatus.

In the present example, in a state where the process cartridge 1 is mounted on the main body 2 of the image forming apparatus, device means (not shown) provided in the main body 2 of the image forming apparatus is connected with drive transmission means of the process cartridge 1, whereby the photosensitive drum 10, the developing apparatus 13, the charging roller 11, etc. are rendered drivable. Also in a state where the process cartridge 1 is mounted on the main body 2 of the image forming apparatus, power sources for supplying voltages to the charging roller 11, the developing roller 16, the developing blade 17 etc. are electrically connected therewith through contacts provided respectively in the process cartridge 1 and the main body 2 of the image forming apparatus.

In the following, forced toner consumption means in the present example will be explained. In the present example, a forced toner consumption mode as in Example 1 is executed in the image forming portions PY, PM, PC, PBk of the respective colors.

The forced toner consumption mode is executed at every 100 image formations. In the forced toner consumption mode, the charging bias source apparatus 24 applies a charging bias of −950 V to the charging rollers 11Y, 11M, 11C, 11Bk thereby charging the photosensitive drums 10Y, 10M, 10C, 10Bk. Then the exposure apparatuses 12Y, 12M, 12C, l2Bk exposes respectively the photosensitive drums 10Y, 10M, 10C, l0Bk by a length of 100 mm in the rotating direction thereof, thereby forming latent solid images of a potential of −120 V.

Also the developing blade bias source apparatus 22 applies, to the developing blades 17Y, 17M, 17C, l7Bk, a blade bias of a rectangular waveform (800 Vpp) changing from −700 V to +100 V at every 100 ms as in Example 1 shown in FIG. 3. Also a developing step is executed by supplying developing biases of −300 V from the developing bias source apparatuses 23Y, 23M, 23C, 23Bk to the developing rollers 16Y, 16M, 16C, l6Bk, respectively. Thus, the oscillating voltage is in advance applied to the developing blade in the developer regulating position thereof, corresponding to the area where the toner is consumed from the developing roller to the photosensitive drum.

In this state, the primary transfer rollers 26Y, 26M, 26C, 26Bk are separated from the photosensitive drums 10Y, 10M, 10C, 10Bk respectively by primary transfer roller separating means (not shown), so that the toners on the photosensitive drums 10Y, 10M, 10C, 10Bk reach the cleaning blades 14Y, 10M, 10C, 10Bk, respectively, and are then carried to the waste toner containers 15Y, 15M, 15C, l5Bk, respectively. Thereafter a next image formation is executed.

[Image Evaluation]

The quality of the image formed with the execution of the forced toner consumption operation was evaluated. As in Example 1, a print test for 5,000 prints was executed with an image of a coverage rate of 5%.

As a result, as in Example 1, an increase in fogging, a white-spots-image in a halftone pattern and a black-lined image in the latter part of the print durability test could be improved.

As explained in the foregoing, the present invention functions advantageously also in an image forming apparatus provided with plural developing means, and, in the forced toner consumption mode, the toner is consumed by executing development in a state of applying a blade bias of a square waveform AC voltage changing from −700 V to +100 V at every 100 ms, thereby achieving improvements in the increase in fogging, the white-spots-image in a halftone pattern and the black-lined image in the latter part of the print durability test.

In the foregoing examples, the forced toner consumption mode is executed at an interval of every 100 prints, but such interval is not restrictive and can be suitably selected, for example at every 50 prints or at every 300 prints.

The forced toner consumption mode can be executed at a predetermined interval, and such predetermined interval may be determined by the number of the recording materials P used for image formation or by other parameters such as a time. Also the present invention is not limited to the execution of the forced toner consumption mode at a predetermined interval, but the forced toner consumption mode may also be executed in an interval between sheets, namely in a region corresponding to the interval of the recording materials in a serial image forming operations for plural recording materials. Furthermore, the forced toner consumption mode may also be executed at a preparatory operation after the formation of an output image, namely a so-called post-rotation.

It is also possible to form a reference image for each color on an intermediate transfer member, and to detect such a reference image with a density sensor thereby controlling the developing bias in each image forming portion. In this manner it is possible to select an optimum developing bias for each color.

Also the bias source for the developing blade may be made common to the plurality of image forming portions. In case the developing biases for the respective color, determined according to the densities of the reference images of the respective colors detected by the density sensor, are mutually different, such a common blade bias is preferably made same as the maximum one of the developing biases. In this manner, in each developing apparatus, the blade bias does not become more positive than the developing bias, whereby the negatively charged toner can be prevented from being deposited on the developing blade.

In Example 2, in case the intermediate transfer member is not separated from the photosensitive members in the forced toner consumption mode, the toners of the respective colors forcedly consumed in the respective image forming portions are preferably deposited on the photosensitive members in such positions that they mutually overlap in a predetermined area on the intermediate transfer member. This is because such overlapping of the toner of the respective colors on the intermediate transfer member reduces the amount of toners transferred onto the intermediate transfer member, thereby alleviating the burden of the cleaning blade 33 for the intermediate transfer member.

Also in a monochromatic image forming mode, the image formation is solely executed in a black image forming portion and not executed in other image forming portions. Therefore, in case of a continuous image formation of a large amount (for example 100 prints) in the black image forming portion only in the monochromatic image forming mode, the forced toner consumption may be executed only in the black image forming portion. On the other hand, in case of a continuous image formation of a large amount (for example 100 prints) in the in a full-color image forming mode, the forced toner consumption is executed in the image forming portions of the respective colors. Thus, in case a monochromatic image forming mode and a full-color image forming mode are selectable, it is preferable to select the image forming portions in which the forced toner consumption is executed, according to the selection of the mode.

Also in Example 2, the image forming apparatus has been explained as of an intermediate transfer type, but, as already known to those skilled in the art, the image forming apparatus is also available in a type having a recording material supporting member instead of the intermediate transfer member, transferring toner images in succession and in superposition from the image forming portions onto a recording material, supported on such a recording material supporting member and conveyed to the image forming portions, then separating the recording material from the recording material supporting member and fixing unfixed toner images, thereby obtaining for example a full-color image. The present invention is likewise applicable also to such image forming apparatus.

Also in the foregoing examples, in case of employing a developing bias formed by superposing an AC voltage and a DC voltage, the forced toner consumption mode can be executed by supplying the developing roller with a superposed voltage of an AC voltage and a DC voltage and the developing blade with a DC voltage. In this manner an alternating electric field can be formed between the developing roller and the developing blade at the forced toner consumption mode.

According to the present invention, a forced toner consumption under formation of an oscillating electric field between a developer carrying member and a developer regulating member enables to forcedly consume a developer of an inferior developing property, thereby allowing to prevent an increase in the fogging and a white-spots-image in a halftone pattern, caused by the toner of a low triboelectricity in a latter part of the service life of the developing apparatus.

Also the fusion-bonding of the developer to the developer regulating member can be prevented to avoid a black-lined image, and the fusion-bonding of the developer to the developer carrying member can be prevented to avoid an increase of the fogging caused by such fusion-bonding, whereby a satisfactory image can be constantly obtained regardless of the state of use.

The present invention is not limited to the foregoing examples but is subject to any and all modifications within the scope and spirit of the technical concept of the present invention.

This application claims priority from Japanese Patent Application No. 2003-301037 filed Aug. 26, 2003, which is hereby incorporated by reference herein.

What is claimed is:

1. A developing apparatus comprising:

a developer carrying member for carrying a developer for developing an electrostatic image, formed on an image bearing member, with the developer;

a developer regulating member for regulating the developer carried on said developer carrying member; and oscillating electric field forming means which forms an oscillating electric field between said developer carrying member and said developer regulating member, wherein a developer transferring electric field for transferring the developer from said developer carrying member to an image non-forming area of said image bearing member is formed, and a period of forming the oscillating electric field is provided while the developer transferring electric field is formed.

2. A developing apparatus according to claim 1, wherein an oscillating voltage is applied to said developer regulating member in the period of forming the oscillating electric field.

3. A developing apparatus according to claim 2, wherein the oscillating voltage has a rectangular waveform.

4. A developing apparatus according to claim 1, wherein the oscillating electric field is an alternating electric field in which orientations of electric fields formed between said developer regulating member and said developer carrying member are alternately changed from one to the other.

5. A developing apparatus according to claim 1 or 2, wherein, in the period of forming the oscillating electric field, a DC voltage without an AC voltage is applied to said developer carrying member.

6. A developing apparatus according to claim 1, wherein, in a developing operation performed by said developer carrying member, a DC voltage without an AC voltage is applied to said developer carrying member.

7. A developing apparatus according to claim 6, wherein said developer carrying member is adapted to be contactable with said image bearing member in the developing operation.

8. A developing apparatus according to claim 1, wherein the formation of the developer transferring electric field is conducted after a passing of a predetermined number of image non-forming areas.

9. A developing apparatus according to claim 1, wherein a developer image is transferred to a recording material, and the image non-forming area is an area corresponding to an interval between the recording materials.

10. A developing apparatus according to claim 1, wherein a developer image is transfeffed from said image bearing member to a recording material, and the image non-forming area is an area where said image bearing member does not contact the recording materials.

11. A developing apparatus according to claim 9 or 10, wherein the developer consuming operation is conducted after a formation of a predetermined number of developer images on the recording materials.

12. A developing apparatus according to claim 1, wherein the developer carrying member is contactable with said image bearing member.

* * * * *

UNITED STATES PATENT AND TRADEMARK OFFICE

CERTIFICATE OF CORRECTION

PATENT NO. : 7,269,382 B2
APPLICATION NO. : 10/923817
DATED : September 11, 2007
INVENTOR(S) : Kazunori Hashimoto It is certified that error appears in the above-identified patent and that said Letters Patent is hereby corrected as shown below:

ON THE TITLE PAGE:
At Item (56), References Cited, FOREIGN PATENT DOCUMENTS, "JP 11249521 A" should read --JP 11-249521 A--.

COLUMN 8:
Line 45, "Example" should read --Example 1--.

COLUMN 11:
Line 5, "an" should read --a--.

COLUMN 12:
Line 29, "exposes" should read --expose--.

COLUMN 16:
Line 8, "transfeffed" should read --transferred--.

Signed and Sealed this

Thirteenth Day of May, 2008

JON W. DUDAS
*Director of the United States Patent and Trademark Office*